United States Patent [19]

Gallagher

[11] 4,109,290

[45] Aug. 22, 1978

[54] MEANS FOR GENERATING A NEGATIVE CHARGE

[75] Inventor: James C. Gallagher, San Diego, Calif.

[73] Assignee: APSEE, Incorporated, San Diego, Calif.

[21] Appl. No.: 788,118

[22] Filed: Apr. 18, 1977

[51] Int. Cl.[2] ..... H01J 3/04

[52] U.S. Cl. ..... 361/231; 55/150

[58] Field of Search ..... 361/225–229, 361/230, 231; 55/101, 102, 123, 150; 313/182, 196, 214; 250/324, 423 R, 426

[56] References Cited

U.S. PATENT DOCUMENTS

| | | | |
|---|---|---|---|
| 3,696,269 | 10/1972 | Hochheiser et al. | 361/231 |
| 3,889,157 | 6/1975 | von Berckheim | 361/231 X |
| 4,037,268 | 7/1977 | Gallagher | 361/231 |

*Primary Examiner*—Harry E. Moose, Jr.

*Attorney, Agent, or Firm*—Fulwider, Patton, Rieber, Lee & Utecht

[57] ABSTRACT

An improved means for generating a negative charge effect in the environment, in which oppositely charged electrically conductive plates are coated with secondary emissive material and are enclosed in a sealed container such as glass that is preferably filled with an inert gas such as argon.

8 Claims, 5 Drawing Figures

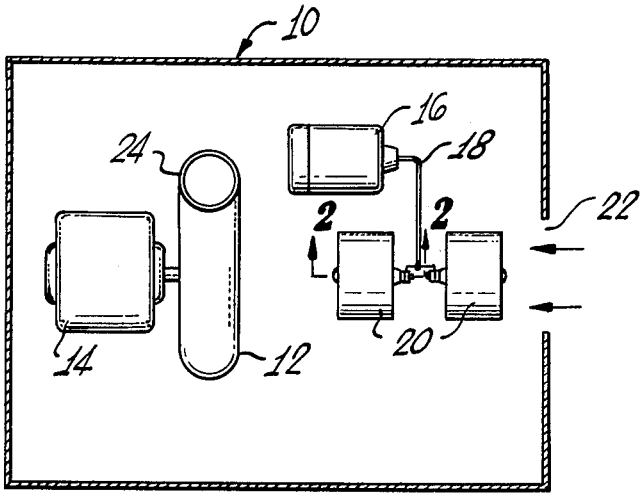
Fig. 1
Fig. 2
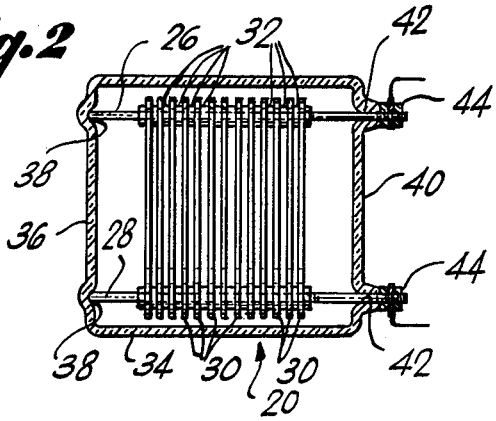
Fig. 3
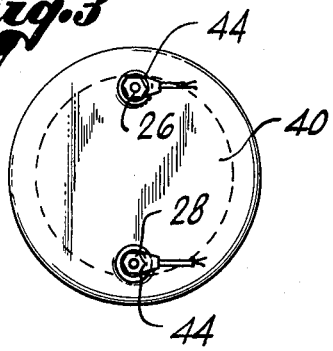
Fig. 4
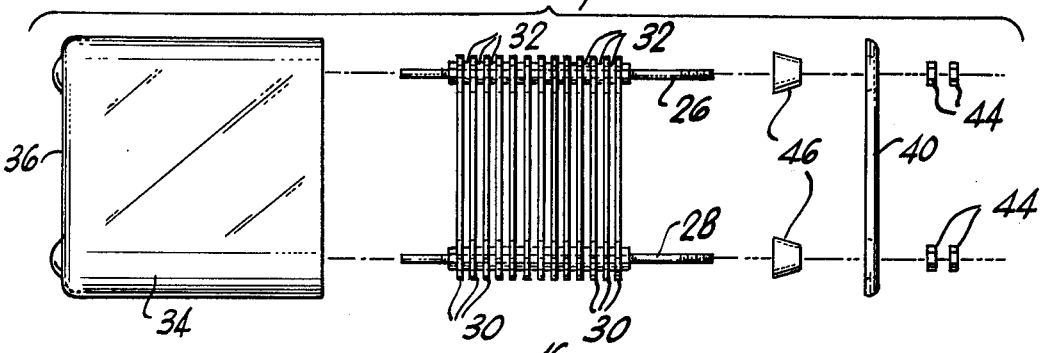
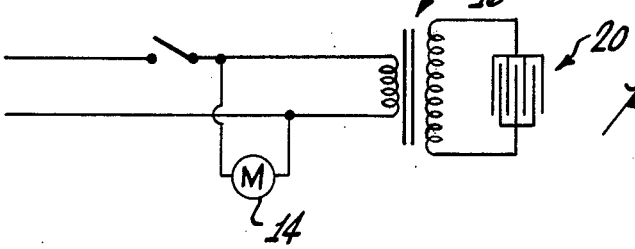
Fig. 5

MEANS FOR GENERATING A NEGATIVE CHARGE

BACKGROUND OF THE INVENTION

In my previous application entitled METHOD AND APPARATUS FOR GENERATING A NEGATIVE CHARGE EFFECT IN AN ENVIRONMENT, Ser. No. 557,869, filed Mar. 12, 1975, now U.S. Pat. No. 4,037,268, I have disclosed a method and apparatus for producing electrons that give a negative charge to surrounding materials such as air, dust, etc. While the device described in that patent works very satisfactorily, it had the disadvantage that air passing between the open plates would deposit dirt on them, impairing their efficiency and requiring cleaning. Also, if the device were operated improperly, ozone could be generated, an undesirable situation.

SUMMARY OF THE INVENTION

As in my previously-mentioned patent, the present invention makes use of a series of spaced conductive plates, alternate plates being connected together and to one side of a transformer or other suitable power source, and the remaining plates connected to the other side of the transformer. The plates are covered by a dielectric material having a high coefficient of secondary electron emission such as a high-alumina ceramic material. In the present invention, the spaced conducting plates and the leads to them are enclosed within a sealed container and the container is preferably filled with an inert gas such as argon, nitrogen or helium, though dry air may be used.

DESCRIPTION OF THE DRAWINGS

FIG. 1 is a plan view of one form of apparatus incorporating my invention such as might be used in a home or other relatively small building;

FIG. 2 is a side elevational view of the interleaved electrode construction with the housing, or container, in cross section;

FIG. 3 is an end view of the electrode structure and its housing;

FIG. 4 is an exploded view of the elements going to make up the electrode structure and its housing; and FIG. 5 is a wiring diagram of the apparatus.

DESCRIPTION OF THE PREFERRED FORM

There are many advantages in creating a negatively charged environment in which the particulate matter carried by the air is given a negative charge as opposed to the positive charge it usually has. The earth may be considered as having a positive charge and, if the dust particles likewise have a positive charge, they are likely to be repelled by the earth and stay in suspension rather than settling to the earth. If the particles are given a negative charge, they tend to become attracted to the earth and settle on the earth's surface instead of remaining airborne. As a result, there is much less airborne particulate matter and walls and ceilings of buildings show much less tendency to become covered with dust. The same general treatment can be used to good advantage in reducing the emissions from chimneys of manufacturing plants, etc.

My previous device, as mentioned, was very effective in producing the negative charge desired, but had the disadvantage that sometimes ozone was generated. Ozone is generated, of course, in the presence of an electrical discharge of the type generally known as a corona discharge. However, the discharge can be prevented from creating ozone that is dispersed through the atmosphere by two different methods: (1) enclosing the discharge within a chamber so that any changes of the gases in the chamber cannot escape outside that chamber; and (2) removing all oxygen from the presence of the corona discharge. In the present invention, I prefer to make use of both of these approaches.

In FIG. 1 of the drawings, the numeral 10 indicates generally an enclosure, such as a sheet metal container, in which there is mounted a blower 12 driven by an electric motor 14. A high voltage transformer 16 has its output terminals 18 connected to a pair of identical discharge units 20. The enclosure 10 has an opening 22 through which air is drawn into the enclosure where it is received by the blower 12 and discharged from a discharge opening 24.

The discharge units 20 are shown in somewhat greater detail in FIG. 2 where it is seen that the unit includes a pair of supporting rods 26 and 28 that extend through a number of spaced interleaved discs 30 with each disc being encased in a dielectric material such as a high alumina ceramic having the characteristic of producing a large number of electrons when subjected to an electrical discharge. As clearly indicated in my previous patent, each of the discs 30 includes an eccentrically located conductive sheet making electrical contact with one of the supporting rods 26 or 28 and being supported thereby while the other rod passes through the ceramic material but does not touch the electrically conducting sheet. Spacers 32 between the discs 30 maintain them in the desired separation.

In the present form of device, the rods 26 and 28, the discs 30, and spacers 32 are enclosed within a chamber 34. For a variety of reasons, I prefer to form the chamber 34 of glass and this is the construction herein illustrated, though it is to be understood that other suitable materials may be used. For convenience, I prefer to form the chamber 34 of a glass cylinder closed at both ends with one end 36 having recesses 38 to receive the ends of the rods 26 and 28 while the other end 40 has apertures 42 through which the rods 26 and 28 project. It is to be understood, of course, that the apertures 42 make a sealing fit with the rods 26 and 28 so that the gas within the chamber 34 does not leak out of the chamber. At their external ends, the rods 26 and 28 are provided with suitable means for making electrical connection to conductors from the transformer 16, such means conveniently being nuts 44 that are threaded on the ends of the rods.

It will be realized that various methods may be used to construct the chamber 34 and in FIG. 4 one suitable form of construction is illustrated. As seen there, the chamber 34 consists of the cylindrical portion that is closed at one end by the bottom 36. Seal members 46 are then placed on the upper ends of the rods 26 and 28 and sealed to these rods to make a gas-tight connection. The seal members 46 with the rods 26 and 28 therein are then inserted in appropriate holes in the top member 40 so that the seal members project through the top member and the outer edges of the seal members are sealed to the top member. The subassembly which consists of the top member 40, the seal members 46, the rods 26 and 28, and the discs 30 and spacers 32 are then inserted in the cylindrical container 34 with the lower ends of the rods 26 and 28 being received in the recesses 38 of the bottom 36. The edge of the top member 40 is then sealed to the chamber 34, the air within the chamber is then withdrawn to be replaced by argon, nitrogen, helium, or other suitable gas, this being accomplished by the usual evacuation, sealing and replacement techniques.

It will be appreciated, of course, that the chamber 34 may be formed of a tubular glass member of appropriate size, closed by a separate bottom 36 that is sealed to the tubular member, or the bottom and tubular member may be cast as a single piece. These are details of construction that may be varied to meet different conditions.

In operation, the discharge assembly 20 consisting of the chamber 34, the rods 26 and 28, with plates 30 and spacers 32, is connected to the output terminals of a high voltage transformer 16. The wiring diagram for this form of construction is illustrated in FIG. 5 and it will be recognized that this is the basic form of circuit that has been disclosed in my previous patent.

While the previous form of apparatus making use of unenclosed plates has operated very satisfactorily, it will be appreciated that it is difficult to maintain uniform operation under such conditions when the relative humidity of the ambient air changes, or when there are changes in the contaminants carried by the air. With the improved form of device disclosed herein, the discharge between the plates 30 always takes place under controlled conditions so that improved results are obtained.

It is to be understood that the presently preferred form of the invention has been disclosed, but changes and modifications such as those suggested and others may be made without departing from the spirit of this invention. Consequently, this patent is not to be limited to the particular form or arrangement of parts herein described and shown except as limited by the claims.

I claim:

1. An electrical discharge generator comprising:

a source of electrical energy having a pair of terminals, a pair of spaced conducting plates separately connected to said pair of terminals of said source of electrical energy;

dielectric means coating said conducting plates, said dielectric means having a high coefficient of secondary election emission;

chamber means enclosing said conducting plates;

and a gas within said chamber.

2. A discharge generator as described in claim 1 in which said chamber means is formed of glass.

3. A discharge generator as described in claim 1 in which said dielectric means is an alumina ceramic.

4. A discharge generator as described in claim 1 in which said gas is one of the group composed of argon, nitrogen and helium.

5. A discharge generator as described in claim 1 in which said chamber means is formed of glass and is sealed to prevent the movement of gas into and out of said chamber.

6. A discharge generator as described in claim 5 in which said dielectric means is an alumina ceramic.

7. A discharge generator as described in claim 5 in which said inert gas is one of the group composed of argon, nitrogen and helium.

8. A discharge generator as described in claim 7 in which said dielectric means is an alumina ceramic.

* * * * *